United States Patent [19]

Maxwell

[11] 4,437,411

[45] Mar. 20, 1984

[54] MULTI-POSITION STUDENT TABLE

[75] Inventor: Ronald M. Maxwell, Leland, Mich.

[73] Assignee: General Equipment Manufacturers, Jackson, Miss.

[21] Appl. No.: 255,807

[22] Filed: Apr. 20, 1981

[51] Int. Cl.[3] ..... A47F 5/12

[52] U.S. Cl. ..... 108/1; 108/9; 108/150; 108/144; 108/145; 248/421; 312/194; 312/209

[58] Field of Search ..... 108/144, 145, 9, 1, 108/150; 248/421; 312/312, 209, 194, 196

[56] References Cited

U.S. PATENT DOCUMENTS

| | | | |
|---|---|---|---|
| 356,909 | 2/1887 | Weller | 108/145 X |
| 368,008 | 8/1887 | Robertson | 108/144 |
| 982,093 | 1/1911 | Russ | 108/144 X |
| 1,193,417 | 8/1916 | Pauls | 108/145 X |
| 2,931,685 | 4/1960 | Butler | 108/9 X |
| 4,196,674 | 4/1980 | Van Laarhoven | 108/9 X |

*Primary Examiner*—James T. McCall

*Attorney, Agent, or Firm*—Emrich, Lee, Brown & Hill

[57] ABSTRACT

A multi-purpose table is adapted for use in schools, and particularly in science or art labs, as a desk or laboratory table. The top of the table may be adjusted in height either to a sitting height or to a standing height. The top may also be placed in either horizontal or sloping position at either adjusted height.

13 Claims, 7 Drawing Figures

FIG. 1
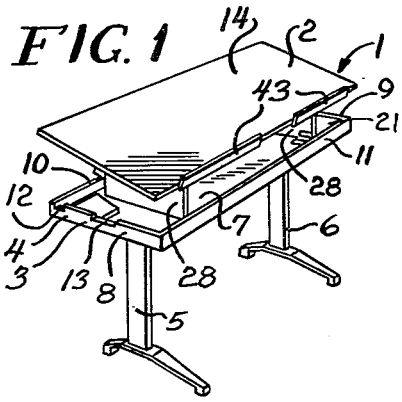
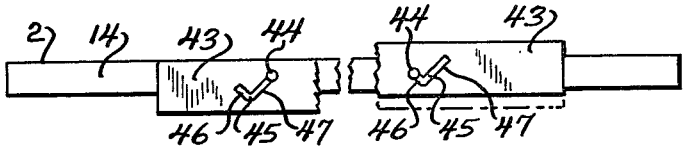
FIG. 2
FIG. 3
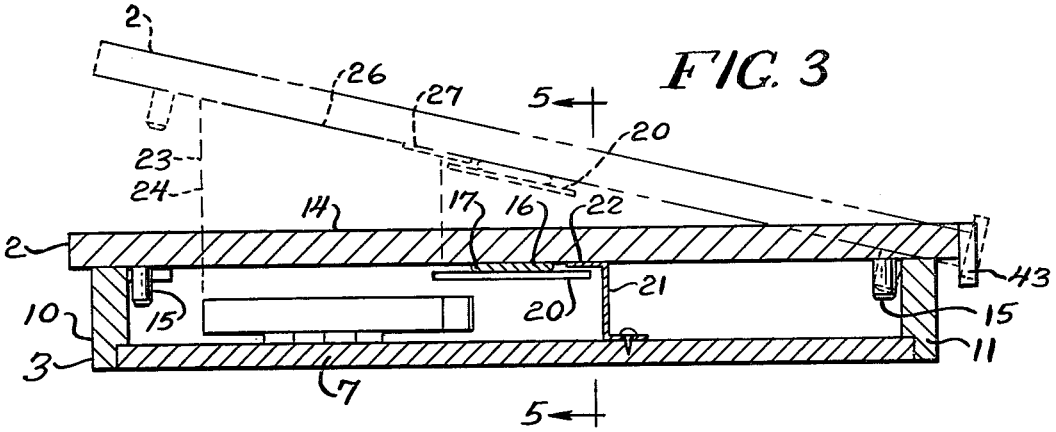
FIG. 4
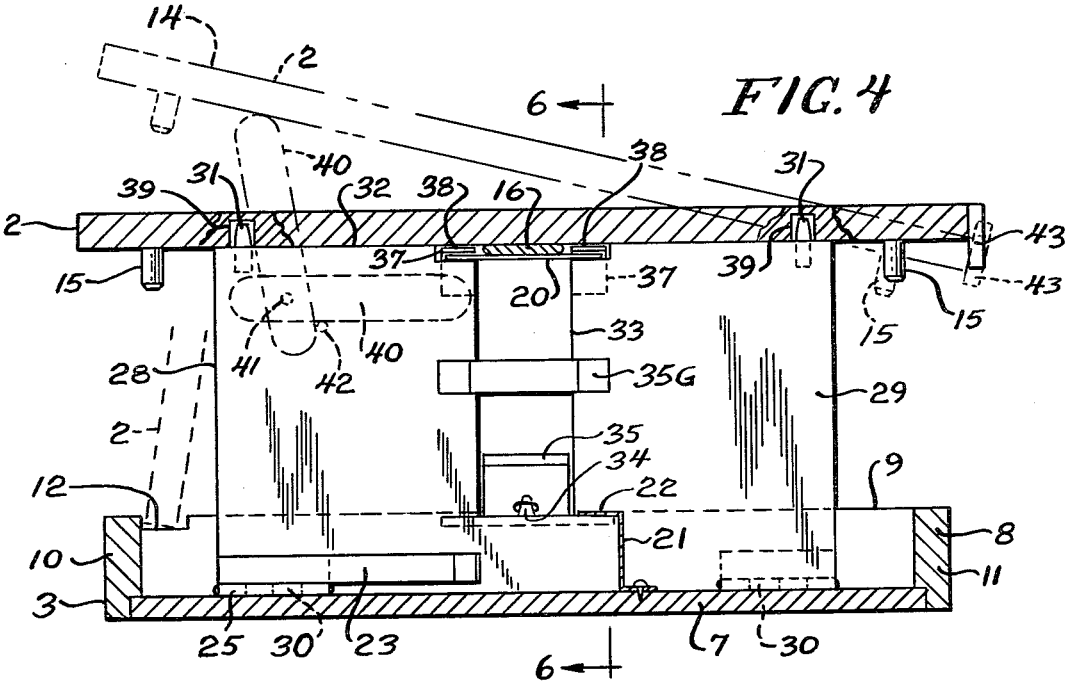

MULTI-POSITION STUDENT TABLE

BACKGROUND AND SUMMARY

This invention relates to tables, and, more particularly, to tables which are designed for easy conversion to different uses or functions.

For reasons of economy, there has been a desire on the part of architects and school personnel to provide more effective use of available student space. This is particularly true in science or art labs where a portion of class time is spent doing "sit down" work, such as taking notes at lectures, studying, writing and recitation, and another portion of class time is spent doing "stand up" work, such as science experiments, art projects, vocational work and debates.

In the past, for example, in a science laboratory, one area was normally set aside just for lecture work, with table top height normally at about 30 inches above the floor to accommodate a student in the sitting position. Stand up laboratory work was done in a separate area having laboratory tables at a height of approximately 36 inches.

In some schools, particularly those designed for smaller classes, both the sitting activities and the standing activities are performed in the same room, thereby requiring two separate areas for the respective activities, and leaving one area not used while the other is being used.

A principal feature of the present invention is that it provides a student table with a top panel which may quickly and easily be converted between a sitting height (at which a seated student is comfortable for doing writing work or the like) and a standing height (at which a standing student is comfortable doing stand up work).

The apparatus includes a base, preferably in the form of an open top rigid box having upstanding side walls and housing first and second side supports pivotally mounted to the base within the box in spaced relation. The side supports are movable between a first position in which they lie flat within the box for storage. In this lowered position, the table top rests directly on and is supported by the side walls of the base.

When the side supports are raised to a second position, the top panel is supported by the side supports.

Each side support is provided with a brace, preferably in the form of a flat, springy wooden member having one end secured to the bottom panel of the box and the other end free to couple to its associated side support when that side support is placed in the raised position. In this manner, the side supports are rigidly secured in their raised position because any force tending to rotate the side supports places the wooden brace either in tension or compression, where it has great strength and will not yield.

A manual latch is also provided for securing the table top either to the base, when the side supports are in the storage position, or to the side supports, when they are secured in the raised position.

Rigidity of the structure in the various use positions is considered an important feature of the invention because rigidity is considered important by the users whose students use the tables. Toward this end, as will be more fully disclosed within, it is important not only that the side supports be rigidly secured in their raised position so that deflection of the side supports is minimal in those positions, but it is also considered important that the table top can be rigidly latched to the side supports in the raised position. Thus, the complete table can be lifted and moved simply by grasping the table top if the apparatus is properly assembled in the raised position.

In addition to permitting the table top to be positioned in a horizontal position at either adjusted height, it may also be inclined or sloped at either adjusted height.

Other features and advantages of the present invention will be apparent to persons skilled in the art from the following detailed description of a preferred embodiment accompanied by the attached drawing wherein identical reference numerals will refer to like parts in the various views.

DESCRIPTION OF THE DRAWING

FIG. 1 is a perspective view of a table embodying the principles of the present invention, showing the table top in elevated, sloping position;

FIG. 2 is a fragmentary, detail front elevational view of the table top shown in FIG. 1;

FIG. 3 is a sectional view looking to the right in FIG. 1, showing the table top in lowered, horizontal position in solid lines, and in lowered, sloping position in broken lines;

FIG. 4 is a sectional view, similar to FIG. 3, but showing the table top in raised, horizontal position in solid lines and in raised, sloping position in broken lines;

DESCRIPTION OF THE EMBODIMENT SHOWN HEREIN

Figure 5:
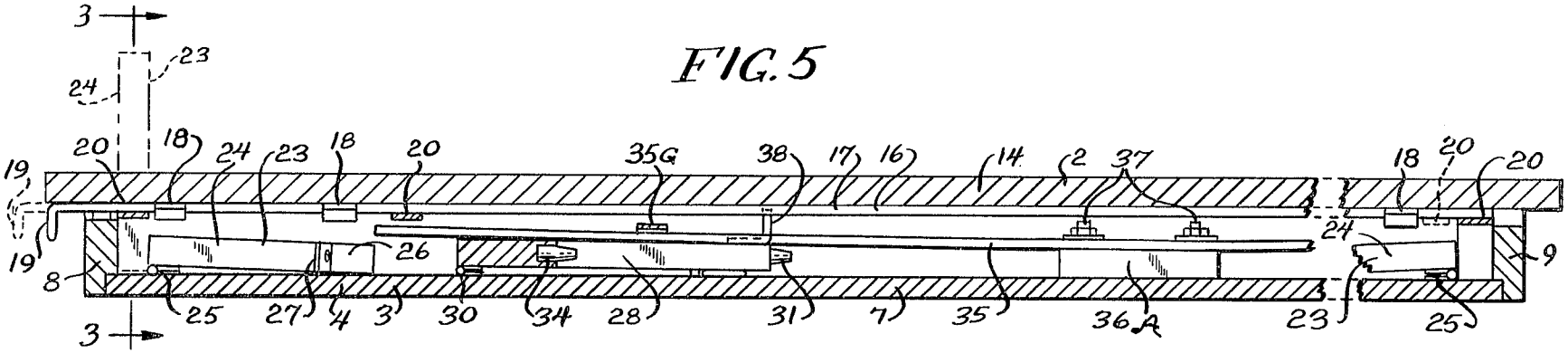
FIG. 5 is a fragmentary, sectional view taken substantially along the line 5—5 in FIG. 3.

A table 1 embodying the principles of the present invention is shown in the drawings to illustrate the present invention.

The table 1 embodies, in general, a table top or top panel 2 removably mounted on a base 3. As will be discussed in greater detail presently, the top panel 2 may be adjusted to any of four positions relative to the base 3, namely, a lowered, level position, as shown in solid lines in FIG. 3; a lowered, sloping position, as shown in broken lines in FIG. 3; a raised, level position, as shown in solid lines in FIG. 4; and a raised, sloping position, as shown in broken lines in FIG. 4.

As will be appreciated by those skilled in the art, with such construction, the table 1 affords a unit which is particularly well adapted for use in school rooms and laboratories, and the like, wherein, in its lowered, level position it may be disposed at a sitting height, such as, for example, 30 inches to accommodate a person sitting at it in the manner in which a normal school desk or library table is used; or it may be disposed in lowered, sloping position to accommodate a person in sitting position, but engaged in art work, reading, or the like; or it may be disposed in an elevated, level position, such as, for example, a height of 36 inches for use as a laboratory table, or the like, by a person disposed in standing position; or it may be disposed in a raised, sloping position for use as a drawing or drafting table, or the like, by a person in standing position.

The base 3 of the table 1 includes a substantially flat, rectangular-shaped body portion 4 in the form of an open top box supported in substantially horizontally extending position by suitable supporting structure such as two legs 5 and 6 illustrated in FIG. 1.

The body portion 4 of the base 3 includes a rectangular flat bottom wall 7, with two end walls 8 and 9 secured to and projecting upwardly from opposite ends of the bottom wall 7; a rear wall 10 mounted on and projecting upwardly from the rear edge of the bottom wall 7; and a front wall 11 mounted on and projecting upwardly from the front edge of the bottom wall 7. Each of the end walls 8 and 9 has a recess 12 in the rear upper edge portion thereof, FIGS. 1 and 4, and the end wall 8 has a recess 13 in the upper central portion thereof, FIG. 1, for purposes which will be discussed in greater detail hereinafter.

The top panel 2 of the table 1 embodies a flat, rigid, rectangular panel 14, which may be of slightly greater length and width than that of the body portion 4 of the base 3, FIGS. 3 and 5. The illustrated top panel 2 has four locating pins 15, projecting downwardly from respective corners of the lower surface of the panel 14 in such position that the pins 15 are disposed in relatively snug engagement within respective corners of the box or body 4 of the base 3, when the top panel 2 is in the lowered position and supported directly by the side walls of the base to thereby hold the top panel 2 against longitudinal and lateral movement relative to the base 3.

The top panel 2 also embodies a locking bar 16, having a substantially flat, rectangular-shaped body portion 17, slidably supported by suitable supporting members, such as mounting straps 18, for longitudinal sliding movement along the longitudinal center line of the lower surface of the panel 14. The body portion 17 of the locking bar 16 has one end portion which projects outwardly through the recess 13 in the base 3, when the top panel 2 is disposed in lowered, operative position on the base 3, and this end portion of the body portion 17 has a handle 19 projecting downwardly therefrom, outwardly of the body portion 4 of the base 3, by which the locking bar 16 may be longitudinally reciprocated through the mounting straps 18 for a purpose which will be discussed in greater detail hereinafter.

The locking bar 16 also embodies four latch members 20, which are in the form of substantially flat, rectangular-shaped members, secured to the lower face of the body portion 17 of the locking bar 16 in substantially perpendicular relation to the length of the latter. The body portion 17 of the locking bar 16 is of such length that when the locking bar 16 is disposed in fully inserted position in the top panel 2, as shown in solid lines in FIGS. 5 and 6, the handle 19 is disposed outwardly of the base 3 and the other end portion of the body portion 17 is disposed in closely adjacent relation to the plan of the inner face of the side wall 9 of the base 3. Two of the latch members 20 are disposed at respective ends of the body portion 17 of the locking bar 16, and the other two of the latch members 20 are disposed in equally-spaced, inward relation to respective ones of the outer latch members 20, only one of the inner latch members 20 being shown in the drawings.

Two substantially Z-shaped latch members 21 are disposed in upright position on the bottom wall 7 of the base 3 in closely adjacent relation to respective ones of the side walls 8 and 9. Each of the latch members 21 includes an upper flange 22, FIGS. 3 and 4, projecting inwardly therefrom into position wherein it is disposed in overlying relation to a respective one of the end latch members 20, when the locking bar 16 is disposed in the aforementioned fully inserted position in the top panel 2. This, it will be seen, is effective to releasably secure the top panel 2 against vertical removal from the base 3, so that, with the locking bar 16 disposed in this position, the table 1 may even be moved and carried by the table top 2.

Figure 6:
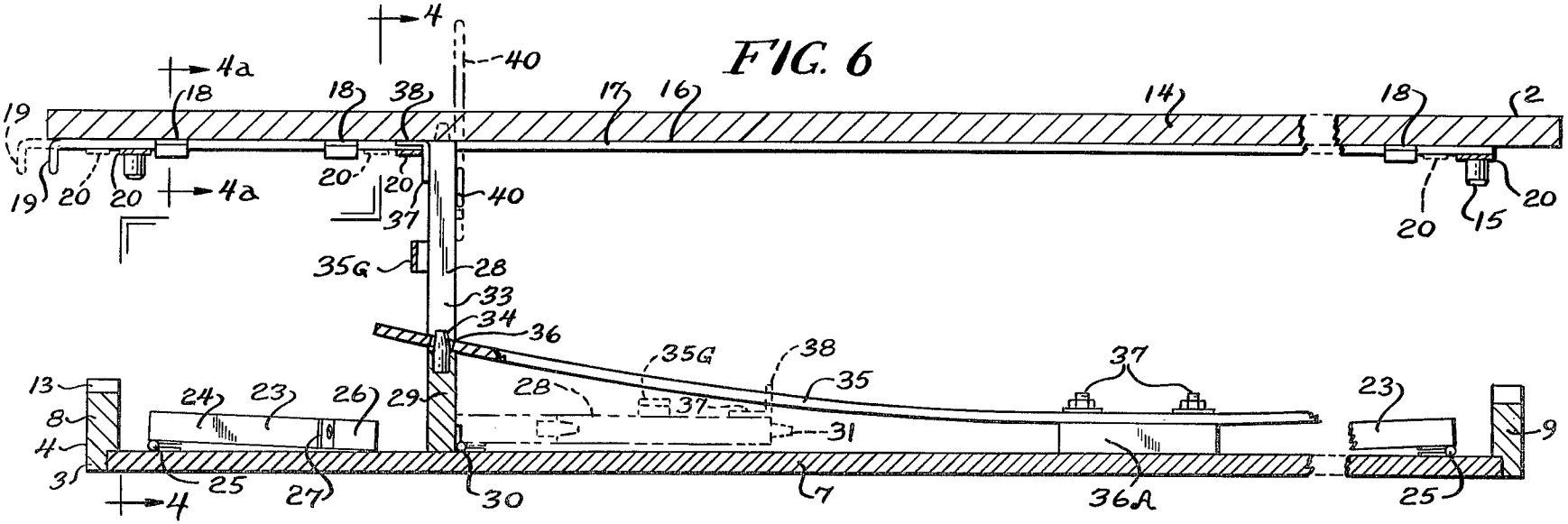
FIG. 6 is a fragmentary, sectional view taken substantially along the line 6—6 in FIG. 4.

When it is desired to remove the table top 2 from the base 3, such as, for the purpose of adjusting it to various positions, this may be readily accomplished by, first, manually pulling the locking bar 16 by the handle 19 into outwardly disposed position, as shown in broken lines, in FIGS. 5 and 6, to thereby move the outer latch members 20 out of the aforementioned underlying relation to the flanges 22 on the respective latch members 21. With the locking bar 16 disposed in such released position, the top panel 2 may be lifted from the base 3.

The base 3 also embodies two outer supports 23 disposed at respective opposite ends thereof. The outer supports 23 are similar in construction and operation, and are similarly disposed in respective end portions of the base 3. Each support 23 embodies a substantially flat panel 24 secured at one end by a hinge 25 to the upper face of the bottom wall 7 of the base 3 for movement between a lowered or storage position, as shown in solid lines in FIG. 5, and a raised or use position as shown in solid lines, with respect to the support 23 disposed adjacent to the end rail 8, in FIG. 5. The panel members 24 are disposed in closely adjacent, substantially parallel relation to the respective side walls 8 and 9, in such position that, when they are disposed in raised position, they are disposed in substantially laterally aligned, spaced relation to the latch members 21 disposed at the respective ends of the base 3, FIG. 5, in outwardly spaced relation to the locking bar 15, FIG. 3. The end surfaces 26 of the respective panels 24, remote from the hinges 25 are disposed at a rearwardly opening, acute angle to the horizontal, when the panels 24 are disposed in the aforementioned upright position.

With the support members 23 disposed in the raised position, the top panel 2, which has been previously removed from the base 3 and rested on its edge in the slots 12, may be mounted on the latter by placing it in such position that the pins 15 at the front edge of the panel 14 are disposed in abutting engagement with the inner face of the front wall 11 of the base 3, and the lower face of the panel 14 rests on top of the surface 26 of the support members 23, as illustrated in broken lines in FIG. 3. As will be appreciated by those skilled in the art, with the table 1 thus assembled, it affords a table which is particularly well adapted for use as a drafting table or drawing table, or the like, for a person seated at it.

Each of the supporting members 23 embodies a latch member, in the form of a plate 27 projecting from the upper surface 26 thereof toward the center of the base 3. The plate members 27 preferably are of the same width as the flanges 22 on the latch members 21 and are disposed in such position on the panel 14 that, when the table top 2 is positioned on the supporting members 23 and the locking bar 16 is in the latching position, the end latch members 20 on the bar 16 are in underlying relation to respective ones of the plate members 27 (which may be slightly twisted to permit a wedging lock action) to thereby prevent the top panel 2 from being vertically lifted from the base 3. With this construction, it will be seen that when the top panel 2 is thus disposed in the latched position shown in broken lines in FIG. 3, the engagement of the pins 15 with the front wall 11 and the side walls 8 and 9 of the base 3 is effective to hold the top panel 2 against forward lateral movement and longitudinal movement relative to the base 3, and the plates 27 on the supporting members 26 are disposed in position to abuttingly engage the body portion 17 of the locking bar 16 to thereby prevent the top panel 2 from being rearwardly moved with respect to the base 3. It will be seen that, with this construction, when the top panel 2 is disposed, and latched in the position shown in broken lines in FIG. 3, it affords a firmly and non-removably supported working surface for use by persons engaged in drawing, and the like.

The base 3 also embodies two inner support members 28, FIG. 1, for supporting the top panel 2 in raised, level position, as shown in FIG. 6. The inner support members 28 are disposed inwardly of the outer support members 23, as illustrated with respect to the support member 28 disposed closest to the end wall 8 of the base 3, FIGS. 5 and 6. The support members 28 are similar in construction, and each embodies a substantially flat panel 29, FIGS. 4, 5 and 6, secured to the upper face of the bottom wall 7 of the base 3 by a hinge 30, for movement between a lowered, storage position within the box or base 3, as shown in broken lines in FIG. 6, and a raised, use position as shown in solid lines in FIG. 6. Each of the support members 28 has two dowel pins 31 (although one has been shown to work equally well) projecting outwardly from respective end portions of the edge 32 of the panel 29 remote from the hinges 30. Also, each of the support members 28 has a recess 33 opening outwardly through the edge portion 32 of the panel 29 and termination at its other end portion in inwardly spaced relation to the edge portion of the panel 29 remote from the edge 32, FIGS. 4 and 6. A dowel pin 34 is disposed in the inner end wall **33*a* of the recess 33 and projects into the recess 33 toward the edge 32, FIGS. 4 and 6**, for a purpose which will be discussed in greater detail hereinafter.

An elongated wood slat or bar 35, in the form of a leaf spring, is securely mounted at its longitudinal center on a suitable supporting block 36A, disposed at the longitudinal center portion of the bottom wall 7 of the base 3 and secured thereto by bolts 37, to thereby support the leaf spring 35 in upwardly spaced relation to the bottom wall 7 of the base 3. The leaf spring 35 is of such length that the opposite ends thereof overlie and extend beyond respective ones of the inner support members 28, as illustrated with respect to the support member 28 disposed closest to the end wall 8 of the base 3, FIGS. 5 and 6, and is disposed in longitudinal alignment with the slots 33 in the support members 28. The leaf spring 35 is of narrower width than the slots 33 and, when the support members 28 are disposed in lowered position, the end portions thereof overlie the substantially horizontally extending support members 28, FIG. 5.

When it is desired to raise the support members 28 from the lowered position shown in solid lines therein, this may be readily accomplished by manually pivoting the support members 28 upwardly on their hinges 30, when the top panel 2 is removed from the base 3. When this occurs, the end portions of the leaf spring 35 are cammed upwardly by the upward movement of the end walls **33*a* of the recesses 33 in the support members 28 into the position shown in FIG. 6. Each end of the leaf spring 35 has an opening 36 extending therethrough, and, when the support members 28 are disposed in fully raised position, the dowel pins 34 move into the respective openings 36 and releasably latch the support members 28 in the aforementioned raised position, FIG. 6. The leaf spring 35 may be manually released from such latching engagement with the support members 28 by manually lifting the respective end portions of the leaf spring 35 upwardly to release the pins 34 from the respective openings 36. A guard 35G, is secured to each support member 28 and extends across the recess 33 in a position to restrict the inward movement of the respective underlying end portion of the leaf spring 35** while not interfering with the leaf spring in the storage position.

When the leaf springs are latched to their associated support members 28 in the raised position, they provide rigid braces which are placed either in tension or compression when forces are applied to collapse the support members. This triangular brace structure has been found to be very effective in making the unit rigid in the raised adjusted position.

The recesses 33 in the support members 28 are vertically aligned with the lock bar 16, and are of greater width than the latter, so that, when the support members 28 are disposed in the aforementioned fully raised position thereof, the body portion 17 of the lock bar 16 is disposed in the upper portions of the recesses 33. Each of the supporting members 28 has two substantially inverter L-shaped brackets 37 secured to the upper portion of the face of the panel 29 thereof facing toward the end wall 8 of the base 3 when the support members 28 are in raised position. The brackets on each of the support members 28 are disposed on opposite sides of the respective recesses 33, with the upper flanges 38 thereof projecting outwardly from the respective panel 29 and in alignment with the edges 32 thereof, for a purpose that will be discussed in greater detail presently.

Figure 4A:
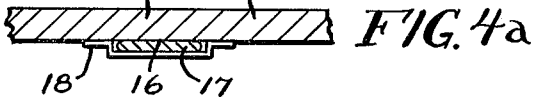
FIG. 4*a* is a detail sectional view of a portion of the table shown in FIG. 4, but taken at a different position, as indicated in FIG. 6.

The panel member 14 of the top panel 2 has four openings 39 in the lower face thereof, the openings 39 being so disposed on the panel 14 that, when the supporting members 28 are disposed in the aforementioned fully raised position, and it is desired to mount the top 2 in horizontally extending, operative position thereon, the top 2 may be manually lowered into such position on the raised support members 28 that each of the dowel pins 31 extend upwardly into a respective one of the openings 39, as shown with respect to two of the dowel pins 31 in FIG. 4. When the top panel 2 is to be so disposed on the support member 28, the locking bar 16 is first moved into outwardly extending position, to thereby disposed the inner latch members 21 into the position shown for one of them in broken lines in FIG. 6, in which position they are disposed to the left of the position the flanges 38 will occupy, as viewed in FIG. 6. After the top panel 2 has been disposed in the aforementioned operative position on the support members 28, the locking bar 16 may again be moved inwardly, to thereby dispose the inner latching members 20 in underlying relation to respective pairs of the flanges 38, as shown in the left end portion of FIG. 6, and thus latch the top 2 against being lifted from the base 3.

With the top panel 2 disposed in the raised, level position, shown in FIG. 6, it will be seen that the table 1 affords a table which is particularly well adapted for use as a laboratory table, or the like, by a person in the standing position.

Each of the support members 28 also includes an elongated supporting lever 40 having one end portion thereof secured to the face of the panel member 29 of the respective supporting member 28 remote from the brackets 37 by a pin 41, for rotation around the latter, between a position wherein the elongated member 40 is disposed in lowered, substantially parallel relation, relative to the edge portion 32 of the respective panel 29, and a position wherein it is disposed in raised, outwardly projecting relation to the edge portion 32, as shown in FIG. 4. Each of the panels 29 includes an abutment member 42 projecting therefrom in position to limit the rotation of the elongated member 40 thereon to movement between the lowered and raised positions, FIG. 4, the member 40, when in the raised position, preferably sloping inwardly and rearwardly away from the front of the base 3 at an acute angle.

With the structure just described, when it is desired to dispose the top panel 2 at the raised, sloping position, the elongated members 40 are rotated from the lowered position to the raised position, when the top panel 2 is removed from the base 3 and the support members 28 are disposed in the raised latched positions. Thereafter, the top panel 2 may be manually lowered into position on the support members 28 such that the dowel pins 31, which are disposed closest to the front wall 11 of the base 3, are disposed in the respective corresponding openings 39 in the table top 2, and the rear portion of the table top 2 rests on the free end portions of the raised elongated members 40, as shown in broken lines in FIG. 4. It will be seen that, with the top 2 in this position, the table 1 affords an effective drafting table, or the like, for a person in a standing position.

In this raised, sloping position of the top panel 2 it is not secured against lifting from the base 3, and if it is desired to lift the table 1, this must be accomplished by lifting on the base 3. However, it will be seen that, in this position of the table top 2, it is firmly supported and is restrained against lateral movement on the base 3.

The table 1 also includes two retaining rails 43 adjustably secured to the front face of the front edge portion of the top panel thereof for movement between a lowered position, as shown to the left in FIG. 2, wherein the upper edge portions of the rails 43 are disposed in uniplanar relation to the top of the top panel, and a raised position, as shown to the right in FIG. 2, wherein the upper edge portions thereof project upwardly above the upper face of the top panel. In the latter position, the retaining rails 43 afford effective abutment members for preventing pencils, or the like, from rolling off from the panel 14 of the top 2, when the top 2 is disposed in a sloping position.

The retaining rails 43 may be secured in any suitable manner to the panel 14 of the table top 2, but preferably, each is secured by two head pins 44 extending outwardly from the panel 14 and disposed in substantially V-shaped slots 45 in the retaining rails 43, one leg 46 of each of the slots being substantially shorter than the other leg 47 thereof. With this construction, when it is desired to dispose the retaining rails in the aforementioned lowered position, they may be moved along the respective pins 44 into position wherein the pins 44 are disposed in the upper end portions of the longer legs 47 of the slots 45, as shown to the left in FIG. 2, and, when it is desired to dispose the rails 43 in raised position, they may be moved along the pins 44 into position wherein the latter are disposed in the upper end portions of the shorter legs 46, as shown to the right in FIG. 2.

It will be remembered that the side walls 8 and 9 of the base 3 have recesses 12 in the rear end portions of their upper surfaces. These are for the purpose of retaining an edge of the top 2 when the top is rested in these slots during adjustment of the various portions of the base 3 into the different use positions. Thus, if two people desire to move the top 2 from one position to another, they may lift the top 2 from the base 3, and rest one edge of the top 2 in the recesses 12, so that the top 2 may be readily held by one hand in upwardly projecting relation, as shown in broken lines in FIG. 4, while the adjustment of the base 3 is being made with the other hand.

From the foregoing, it will be seen that the present invention affords a novel table which may be quickly and easily adjusted to different heights in a novel and expeditious manner.

Also, it will be seen that the present invention affords a novel table, the top of which may be quickly and easily adjusted to a horizontally extending position or an upwardly sloping position in a novel and expeditious manner.

In addition, it will be seen that the present invention affords a novel table embodying a removable table top, which may be latched into secure assembled position in a novel and expeditious manner.

Also, it will be seen that the present invention affords a novel table of the aforementioned type which is practical and efficient in operation, and which may be readily and economically produced commercially.

Thus, while I have illustrated and described the preferred embodiment of my invention, it is to be understood that it is capable of variation and modification, and I therefore do not wish to be limited to the precise details set forth, but desire to avail myself of such changes and alterations as fall within the scope of the following claims.

I claim:

1. Apparatus for rigidly positioning a top panel at a first or a second height comprising: a base; first engagement members secured to said base; a top panel providing a work surface adapted to be positioned at one of said heights relative to said base; first and second side supports hingedly mounted to said base in spaced relation and movable between a first storage position in which said supports lie flat within said base and said top panel is supported by said base, and a second position in which said supports are raised and said top panel is supported by said first and second support means at a height above said first position; brace means for rigidly securing said first and second support means in said raised position; and manual latch means comprising a reciprocable latch member slidably carried on the under surface of said top panel and manually moveable between a latch position and a release position for rigidly securing said top panel to said base at said first height by coupling to said first engagement members when said side supports are placed in said storage position and for rigidly securing said top panel to said side supports when the same are placed in said second position and said latch member is in said latch position.

2. The apparatus of claim 1 wherein said brace means comprises first and second resilient flat portions extending respectively over said first and second side supports, said portions being rigidly secured to said base at a location remote from said respective side members and free to yield in a vertical direction as said side support members are raised to the use position.

3. The apparatus of claim 2 wherein each of said side support members includes a projection and each of said brace portions includes an aperture to receive an associated projection of one of said side supports when said side supports are in said raised positions to rigidly secure their associated side supports in the raised position.

4. The apparatus of claim 2 further comprising second engagement means on said first and second side supports respectively and engagable by said reciprocable latch member when said side supports are in said raised position to rigidly couple said top panel to said side supports when the same are in said raised position.

5. The apparatus of claim 4 wherein each of said side supports further includes at least one projection adapted to register with a corresponding aperture in the undersurface of said top panel when said side members are raised to prevent relative lateral motion of said top panel when the same is assembled to said raised side supports.

6. The apparatus of claim 5 wherein each of said side supports further includes a vertically extendable member at the end opposite said one projection, whereby said top panel may rest on said side supports, being coupled thereto by means of said pins extending into said apertures and further resting on said extendable members in the extended position, whereby said top panel is slanted in said raised position.

7. The apparatus of claim 6 further including third and fourth side support members hinged to said base and movable between a storage position and a raised position for receiving said top panel and located to one side of a center line of said top panel for permitting said top panel to be placed in a slanted position at said first height; said latch means being further adapted for securing said top panel to said third and fourth support members in said slanted position.

8. The apparatus of claim 7 wherein said base is in the form of an open top box having upright side walls in rectangular relationship with one another and adapted to house said first and second side supports and said third and fourth side support members when the latter are placed in their respective storage positions.

9. The apparatus of claim 8 wherein opposite side walls of said base define slots in the upper surfaces thereof, said slots being aligned and adapted to receive an edge of said top panel in vertical resting position and at a location free of mechanism housed in said base.

10. The apparatus of claim 9 wherein said apparatus is a table and wherein said first and second heights of said top panel are located respectively to accommodate a person sitting at said table and standing at said table.

11. A multi-position table comprising: a base of generally rectangular shape and in the form of an open-top box; leg means for supporting said base on a floor; a top adapted to be positioned relative to said base above the open top thereof; a latch bar carrying latch means mounted to said top for reciprocable movement between latched and unlatched positions; first engagement means attached to said base and engageable by said latch means when said top is placed directly on said base and said latch bar is moved to said latched position to thereby firmly secure said top to said base in a first, lowered horizontal position; a pair of first support members hinged to said base and moveable between a storage position within said base, and a raised position, said first support members defining inclined upper support surfaces in the raised position to support said top in a second, lowered inclined position; said first support members including second engagement means engageable by said latch means members when said bar is in said latched position to secure said top to said first support members in said second position; a pair of second support members hinged to said base and moveable between a storage position within said base and a raised position above the raised position of said first support members, and including third engagement means engageable by said latch means when said bar is in said latch position and said second support members are in said raised position to secure said top to said second support members in a third position at a height elevated above said base; and leaf spring means secured to said base and including releasable coupling means for releasably holding said second support means in said raised position.

12. The apparatus of claim 11 further comprising first and second elongated members rotatable mounted respectively to said second support members and movable between a lowered position and a raised position to one side of the transverse center of said base and adapted in said raised position to support said top in an inclined elevated position; said second support members including upwardly extending projections in the raised position adapted to be received in corresponding openings in the lower surface of said top to provide lateral stability to said top in said raised, inclined position.

13. The apparatus of claim 11 wherein said base includes upright side walls and said first support members are located immediately adjacent respective ones of said side walls of said base when raised to their respective elevated positions.

* * * * *

UNITED STATES PATENT AND TRADEMARK OFFICE

CERTIFICATE OF CORRECTION

PATENT NO. : 4,437,411

DATED : March 20, 1984

INVENTOR(S) : Ronald M. Maxwell

It is certified that error appears in the above—identified patent and that said Letters Patent is hereby corrected as shown below:

In Col. 3, line 55, "plan" should be --plane--.

Signed and Sealed this

*Tenth* Day of *July 1984*

[SEAL]

*Attest:*

GERALD J. MOSSINGHOFF

*Attesting Officer*

*Commissioner of Patents and Trademarks*